United States Patent [19]

Riquet

[11] Patent Number: 4,735,255

[45] Date of Patent: Apr. 5, 1988

[54] MOULD PERMITTING REGULATION OF THE LEVEL AT WHICH IT IS IN CONTACT WITH THE FREE SURFACE OF THE METAL IN A VERTICAL CASTING OPERATION

[75] Inventor: Jean-Pierre Riquet, Saint Etienne de Saint Geoirs, France

[73] Assignee: Cegedur Societe de Transformation de l'Aluminium Pechiney, Paris, France

[21] Appl. No.: 24,703

[22] Filed: Mar. 11, 1987

[30] Foreign Application Priority Data

Mar. 13, 1986 [FR] France ..... 86 04117

[51] Int. Cl.[4] ..... B22D 27/02

[52] U.S. Cl. ..... 164/502; 164/418

[58] Field of Search ..... 164/502, 503, 147.1, 164/466, 467, 498, 418

[56] References Cited

U.S. PATENT DOCUMENTS 3,467,166 9/1969 Getselev et al. ..... 164/503

3,702,155 11/1972 Getselev ..... 164/503

FOREIGN PATENT DOCUMENTS 2108681 10/1971 Fed. Rep. of Germany ..... 164/467

*Primary Examiner*—Kuang Y. Lin

*Attorney, Agent, or Firm*—Dennison, Meserole, Pollack & Scheiner

[57] ABSTRACT

The invention relates to a mould for vertical casting of molten metal and including a means for regulating the level at which the inner surface of the mould contacts the free surface of the metal being cast. The mould is formed at least in its lower part of metal, and the means for regulating the level comprises an electrically insulating material intentionally coated onto the inner surface of the mould, an insert of electrically insulating material disposed along at least one generatrix of the mould, over the entire height and thickness of the mould, and two terminals for connection to a source of alternating current provided on the outer surface of the mould at its lower part, with one terminal provided on each side of the insert. The mould finds application in the casting of metallurgical semi-finished products, in particular of aluminum and aluminum alloys.

11 Claims, 2 Drawing Sheets

Figure 1:
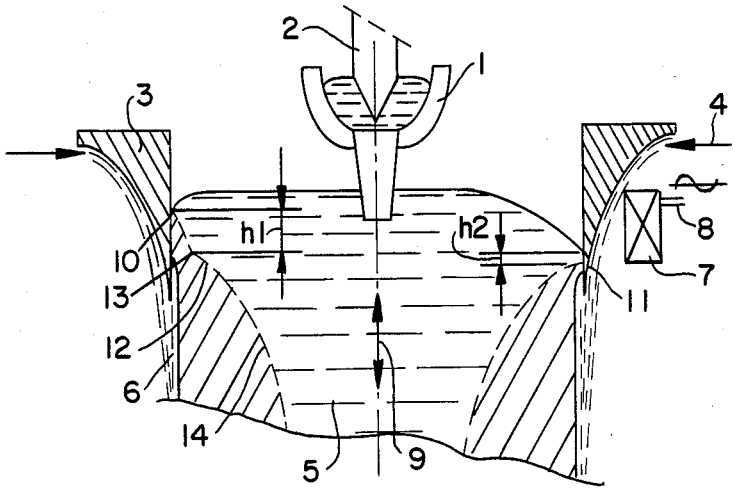

MOULD PERMITTING REGULATION OF THE LEVEL AT WHICH IT IS IN CONTACT WITH THE FREE SURFACE OF THE METAL IN A VERTICAL CASTING OPERATION

The present invention concerns a mould permitting regulation of the level at which it is in contact with the free surface of the metal in a vertical casting operation.

When producing metallurgical semi-products by casting light or ferrous metals such as aluminium and alloys thereof, the man skilled in the art seeks to produce ingots, billets, plates, etc., which have the best possible degree of physical and chemical homogeneity, in order to avoid the appearance of certain defects when those products are subsequently worked to produce sheets, wires, etc.

Now, most of the casting processes which are used in industry at the present time give rise, when the metal goes from the liquid state to the solid state, to the formation of homogeneity faults of greater or lesser magnitude, which are essentially due to cooling conditions differing from one point of the cast products to another. Thus, in the casting process which involves casting the metal in a mould with a vertical passage, wherein the metal is successively cooled indirectly by way of the mould and then directly by means of a sheet of water, an external layer referred to as the "primary cortical layer" is found to be present in the semi-products. The structure and the composition of that layer differ from those of the internal part of the semi-product, the layer resulting from indirect cooling of the metal in contact with the mould. Moreover, other heterogeneity phenomena which are much less pronounced but which are all as troublesome may appear, such as "pocks" or small pits which are due in particular to dispersion in the metal material of the layer of oxide which is formed at the surface of the liquid metal which is in contact with the atmosphere.

It is true to say that the man skilled in the art has not remained inactive when faced with those problems and he has put forward a certain number of solutions which are more or less satisfactory, aiming to eliminate or at least reduce the seriousness of such heterogeneity.

Thus, in French Pat. No. 1 509 962, the man skilled in the art has recommended using electromagnetic casting, an already conventional procedure in which, by virtue of the metal being confined by means of forces of electromagnetic origin, it is possible to eliminate the mould and thus to avoid the occurrence of the cortical layer since there is no longer any indirect cooling effect.

It is thus possible to arrive at an improvement in the homogeneity of the semi-manufactured products.

However, that procedure suffers from the following disadvantages:

it is necessary to equip the casting plant with an electrical installation of which is relatively complicated and expensive because of the need to provide currents at non-industrial frequency (500 to 4000 Hz), in order to generate a suitable confining field, the risk of heterogeneity due to the formation of pitting is increased on the one hand due to the absence of a mould and therefore an increase in the surface area of liquid metal which is capable of suffering from oxidation, and on the other hand due to the phenomenon of stirring of the liquid mass caused by the confining field which contributes greatly to dislocation of the film of oxide and the dispersion thereof in the metal, it is often difficult to generate a suitable confinement effect when starting up the electromagnetic casting operation, and the safety of the personnel may be put at risk when casting aluminium and alloys thereof as, in the even of an electrical failure, the liquid metal which is no longer confined spreads to the outside of the mould and can come into contact with the fluid for producing the direct cooling effect, thereby causing an explosion.

Other, simpler solutions have also been proposed for reducing the thickness of the cortical layer. For example, French Pat. No. 1 398 526 teaches the use of a strip of fiberfrax which is glued to the mould so as to reduce the height of the metal in contact with the mould and therefore to reduce the effects due to indirect cooling. However, that reduction in height cannot be fixed once and for all as it depends in particular on the speed of casting. Thus, when that parameter varies, it is necessary either to change the mould or at least to alter the height of the strip. That gives rise to a lack of flexibility in a solution which ultimately provides only for partial suppression of the heterogeneity phenomena.

French Pat. No. 1 496 241 provides for eliminating the disadvantages of indirect cooling by using a non-cooled graphite mould, but that system then encounters problems in regard to frequent maintenance and changing of the mould due to the fragility of that material.

Another solution involves using moulds with a grooved or corrugated inside surface, by means of which the thickness of the cortical layer is reduced by more than 30% when casting for example aluminium 1050. However, besides the machining of those moulds which substantially increases the cost thereof, that system also suffers from the disadvantages involved in adapting the mould and in this case the grooves or corrugations to each casting speed.

Another known process is casting under load with a raised reservoir, referred to as "HOT TOP" casting, but that procedure also suffers from the disadvantage of resulting in periodic solidification of the meniscus, which is the cause of small ripples at the surface of the semi-manufactured products, as well as involving difficulties when starting up the casting procedure.

Finally, more recently, French Pat. No. 2 417 357 claimed a process wherein the axial length of the portion of the mould in contact with the liquid metal is varied by using a sleeve which slides on the inside wall of the mould. Such a system has the disadvantage, in the event of the metal solidifying in an untimely fashion, that it gives rise to an adhesion effect between the mould and the sleeve, thus causing tearing damage to those components at the time when the sliding movement is produced.

It is for that reason that the present applicants, being aware of the problems raised by those procedures, in order to produce homogenous semi-manufactured products in which the thickness of the cortical layer is virtually zero, the material is of refined grain and the skin is free from pitting, sought and developed a process which has the following advantages over the prior-art processes:

the use of electrical installations which are less complicated than those which are required by the conventional electromagnetic casting process, easy transfer from the phase of starting up the casting operation to the steady-state phase of casting, easy adaptation to variations in parameters such as the speed of casting since the process does not require any modification in the equipment such as a change of mould, application to any type of conventional ingot mould, the absence of any apparatus which involves moving components, the risks of explosion due to leakage of the liquid metal are less serious than with conventional electromagnetic casting.

In order to arrive at that result, the applicants based themselves on the following observations:

on the one hand, the operation of starting off casting is easier in proportion to the level of metal in the mould being higher. Indeed, with a low level, the glass cloth filter which regularizes the level and the feed of metal to the mould approaches the leading edge of solidification of the metal, and gives rise to the risk, when dealing with semi-manufactured products of small dimensions, of being clogged by untimely solidification of the metal and no longer being able to perform its proper function. Likewise, the phenomenon of cambering which occurs with semi-manufactured products of substantial width also prevents the casting operation from being started up at a low level of metal, and on the other hand, in the steady-state phase, it is preferable to cast with a height of metal in the mould which is as low as possible as that limits the height of the contact between the metal and the wall of the mould and accordingly reduces the thickness of the cortical zone which, as has been pointed out hereinbefore, is essentially due to cooling of the metal by way of the mould.

Therefore, starting from a conventional mould with its contingencies, that is to say, while retaining in the mould a height of metal which is constant since it is fixed by the position of the float and which is sufficient in order not to interfere with proper operation of the filter, it was necessary to be able to limit as far as possible the height over which the metal is in contact with the surface of the mould, which in short amounted to finding a way of regulating the level of the line of contact of the free surface of the liquid metal with the wall of the mould.

That way comprises applying to the liquid in the course of solidification, a periodic magnetic field of variable intensity and with a direction substantially parallel to the axis of the mould, and adapting the intensity thereof in dependence on the desired level.

It has been found in fact that, by placing around the mould at least one circular coil constituted by an electrical circuit formed by one or more windings, and by feeding it with an alternating current at adequate industrial voltage, it was possible to modify the profile of the metal meniscus and in particular to vary the level of the above-mentioned line of contact of the metal with the mould, in direct relationship to the variations in the feed voltage and correlatively the intensity of the field generated.

Thus, by increasing the strength or intensity of the field, it was possible to lower the level and consequently reduce the height of the zone of metal contact or, on the other hand, by reducing the strength of intensity of the field, it was possible to raise the above-mentioned level and consequently increase the above-mentioned height.

The attraction of such a process is therefore that it makes it possible as desired to reduce the height of metal-mould contact and consequently the thickness of the cortical layer in a simple manner with a coil which is supplied with a current at an industrial frequency of 50 or 60 Hz, with the knowledge that the only repercussion of any electrical failure will be to vary the height of metal in the mould, that is to say any risk of liquid metal leakage will be avoided, which is not the case with electromagnetic casting.

Moreover, while the presence of a mould limits the possibility of oxidation of the liquid metal at the level of the meniscus, the mould, by virtue of its contact with the metal, prevents any displacement of the film of oxide towards the side wall and therefore any danger of pitting at the surface of the semi-manufactured product.

Moreover, the field applied to the metal also has the effect of generating forces within the liquid which homogenize the cooling effect and tend to cause a refining action in respect of the cast grain.

However, the solution which involves surround the mould with an annular coil, while having the great advantage of in no way altering the conventional set-up of the casting installations, does in contrast suffer from the disadvantage of involving a substantial level of consumption of electrical power. Indeed, the mould absorbs a part of the magnetic field which represents approximately 15 to 30% of the total energy consumed. In addition, because of the presence of the mould, the coil must be spaced away from the liquid metal; now, as the strength of the magnetic field decreases in proportion to increasing spacing, that results in an additional waste of energy.

It is for that reason that, being concerned with saving on energy and being aware of the fact that the cost of electrical installations increases rapidly in dependence on the level of output strength required, the applicants sought a way of reducing the electrical strength necessary for operation of that type of process.

The applicants' efforts resulted in the creation of a mould characterised in that it is formed at least in its lower part by a metal, that it is internally coated with a film of electrically insulating material, that it has an insert of electrically insulating material along at least one generatrix, over its entire height and over its entire thickness, and that it is externally provided at the level of said lower part with two terminals disposed on respective sides of said insert and connected to an alternating current source.

The applicants found that such a mould played precisely the same part as the coil as it made it possible to generate a magnetic field whose effect was to modify the profile of the meniscus of the cast metal and to vary the level of the line of contact between the metal and the mould. This invention provides that it is possible to eliminate the coil with all the disadvantages thereof, in particular the disadvantage of its high level of consumption of electrical energy.

As the current necessary for generating the magnetic field is relatively strong, it is necessary for the mould to be made of metal and preferably a metal having a low level of electrical resistivity such as copper or aluminium or their alloys. That does not give rise to any problems since moulds are conventionally formed by such metals.

However it is not necessary for the mould to be entirely of metal and it is even preferable to use composite moulds in which the use of such a material is limited to the lower part and the upper part comprising the collar portion is produced with a material which, if not electrically insulating, is at least a poor conductor of electricity such as for example a stainless steel. Indeed, it will be seen hereinafter that better results are achieved by thus limiting the height over which the current flows in the mould.

Such composite moulds are constructed by using assembly means which are well known to the man skilled in the art.

The mould according to the invention is characterized in particular in that it is internally coated with a film of electrically insulating material in order to prevent current from flowing from the mould towards the cast metal. The film is completely to cover the internal surface of the mould, from top to bottom. It is desirable for the film not to be a good thermal insulator as it would interfere with mould-metal heat exchanges and would have troublesome repercussions on the quality of the products obtained. It is for that reason that the applicants were led to study that problem in greater detail and after many tests found that certain films only could be used.

Particularly when the mould is of aluminium or one of its alloys, that involves a film of aluminium oxide which is produced by anodisation. In fact, irrespective of the type of anodisation used, such a film forms a continuous coating which is relatively resistant to the flow of current and which is a good conductor of heat since thicknesses which are as small as 1 μm permit the application of voltages of close to 100 volts. In addition, that kind of coating is highly resistant to abrasion and may be impregnated with a lubricating agent (hot grease) in order to facilitate the casting operation. Furthermore, that oxide lends itself readily to colouring, which makes it possible to detect any deterioration in the coating in the course of manufacture.

Another type of coating which gives the same advantages as the oxide is a film of enamel, the production of which involves processes with which the man skilled in the art is familiar.

Mention may also be made of films of fluorocarbon resin with which the results are also excellent and whose fragility is largely compensated for, by its excellent frictional properties which make it possible to avoid any use of a lubricating agent.

Another solution which is an attractive proposition involves separating the film from the cast metal by a layer of graphite which is a few millimeters in thickness, thus also avoiding the need to use a lubricating agent.

The invention is also characterized in that the mould, along at least one generatrix, over its entire height and over its entire thickness, has an insert of electrically insulating material. Indeed, in order for the mould to perform a function similar to that of the coil, it must permit the current which flows therethrough to pass in a direction perpendicular to the axis of the mould. That is achived by splitting the mould over its entire height, inserting an electrical insulation material into that slit and feeding the mould with alternating current from two terminals which are disposed on its outside wall on respective sides of said insert and at the level of the lower metal part thereof. The insulation may be any material which is known to the man skilled in the art such as for example mica, including the materials constituting the film and in particular in the case of a mould of aluminium or one of its alloys, the oxide which is produced by anodisation. The two terminals for connection to the electrical supply system are of any known type.

Figure 2:
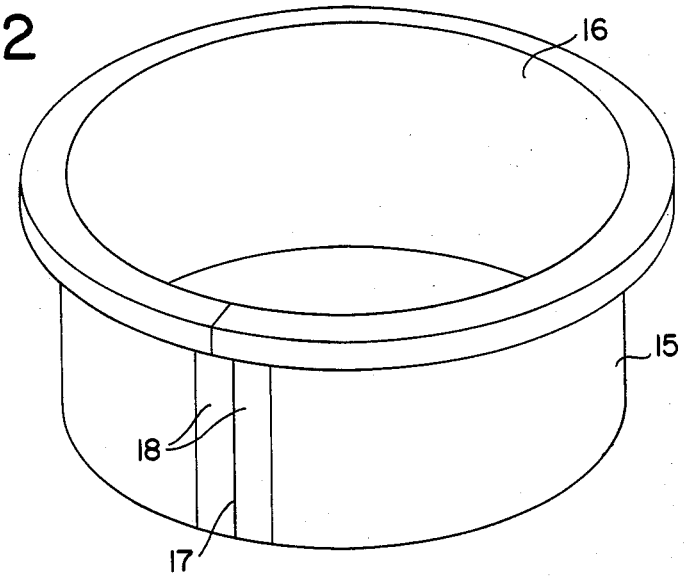
Figure 3:
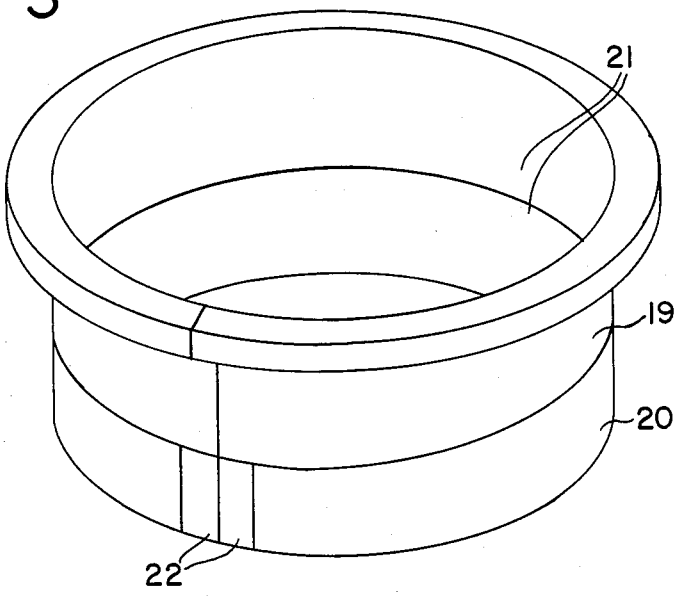

The invention will be better appreciated by reference to the accompanying drawings in which:

FIG. 1 is a view in vertical section of the two mould halves, that on the left being used without regulation of the level of metal and that on the right being provided with an annular coil to permit such regulation, FIG. 2 is a perspective view of a non-metal mould according to the invention, and FIG. 3 is a perspective view of a composite mould according to the invention.

Referring to FIG. 1, shown therein is a nozzle 1 for a feed of liquid material, a level regulating stopper rod 2, and a mould 3 which is cooled directly by a fluid 4 which then cools the metal 5 directly at the point 6. The right-hand mould half is fitted with a coil 7 which is supplied with an a.c. voltage 8 in order to generate the magnetic field in the direction 9 and to cause a lowering of the level of the line of contact of the surface of the metal with the mould from a point 10 in the prior-art casting operation to the point 11 in accordance with the process, which point is disposed at the level of the intersection 12 of the leading edge of solidification of the metal, as at 13, resulting from indirect cooling, and the leading edge of solidification as at 14, which results from direct cooling. It will be seen therefore that the height over which the metal is in contact with the mould has been reduced from a height $h_1$ to an extremely small height $h_2$ which can be assimilated to the point 11.

Referring to FIG. 2, shown therein is a mould 15 of aluminium which is internally coated with a film 16 of oxide produced by anodisation, having on one of its generatrices a slit 17, the two facing faces of which have also been anodised, together with two terminals 18 which are connected to an alternating current source (not shown).

Referring to FIG. 3, shown therein is a composite mould formed by an upper part 19 of stainless steel and a lower part 20 of aluminium. The assembly is internally coated with a film 21 of fluorocarbon resin. Disposed on the lower part of the mould and on the outside thereof are two terminals 22 connected to an alternating current source (not shown).

The invention can be illustrated by reference to the following examples of use thereof which involve a comparison, for three types of mould, in respect of the strength necessary to lower the level of the line of contact of the metal with the mould respectively by 15, 30 and 40 mm in the case of an aluminium mould with a section measuring 1100×300 mm and in which the level of metal at the centre was fixed at 60 mm from the base of the mould.

The following types of mould were considered:

type 1: a mould of internally anodised aluminium, in accordance with the invention, measuring 104 mm in height, type 2: a composite mould according to the invention of anodised aluminium in regard to the lower part, measuring 60 mm in height, and insulating material in regard to the upper part, measuring 44 mm in height, and type 3: a mould of aluminium of the same total height, which is used in accordance with the prior art, that is to say without an internal coating or insert, with the field being generated by an annular coil.

The results are set forth in the following Table:

| Lowering of the level of the line of contact in mm | Strength in amperes | | |
|---|---|---|---|
| | Type 1 | Type 2 | Type 3 |
| 15 | 4600 | 3400 | 9800 |
| 30 | 6200 | 5300 | 14000 |

-continued

| Lowering of the level of the line of contact in mm | Strength in amperes | | |
|---|---|---|---|
| | Type 1 | Type 2 | Type 3 |
| 40 | 7000 | 6300 | 16000 |

It will be seen that, irrespective of the lowering of the level, it is the composite mould (type 2) which gives the lowest level of strength, that is to say, it is that mould which permits the maximum reduction in the cost of the apparatus. Having regard to the electrical losses in the current supply means, it is also that mould which, taken overall, consumes the smallest amount of electrical energy. Although type 1 has a lower level of performance, it nonetheless constitutes a very substantial advance in comparison with the moulds of the prior art since the level of current strength is practically divided by 2.

The present invention finds application in the casting of metallurgical semi-manufactured products, in particular of aluminium and alloys thereof, such as for example lithium-bearing alloys, and in which there is a wish to produce both a cortical zone of practically zero thickness, a fine grain without the initial addition of refining agents such as ATSB, and an absence of pitting.

I claim:

1. A mould (15) for vertical casting of molten metal and having an inner surface which can confine the metal being cast, and an outer surface, said mould being formed at least in its lower part of metal and comprising means for regulating the level at which the inner surface contacts the free surface of the metal being cast, said means for regulating comprising a film (16) of electrically insulating material intentionally coated onto said inner surface, an insert (17) of electrically insulating material disposed along at least one generatrix of said mould, over the entire height and thickness of said mould, and two terminals for connection to a source of alternating current provided on the outer surface of said mould in its lower part, one of said terminals provided on each side of said insert.

2. A mould according to claim 1 characterised in that the metal which forms the mould has a low level of electrical resistivity.

3. A mould according to claim 1 characterised in that it comprises an upper part (19) formed by an insulating material or a material which is a poor conductor of electricity.

4. A mould according to claim 1 characterized in that the metal forming the mould is selected from the group consisting of copper, aluminum and their alloys.

5. A mould according to claim 4 characterised in that when the metal forming the mould is aluminium or alloys thereof, the internal coating is a film of aluminum oxide produced by anodisation.

6. A mould according to claim 5 characterised in that the film is coloured.

7. A mould according to claim 1 characterised in that the internal coating is a film of enamel.

8. A mould according to claim 1 characterised in that the internal coating is a film of fluorocarbon resin.

9. A mould according to claim 1 characterised in that the internal coating is covered with a lubricating agent.

10. A mould according to claim 1 characterised in that the film is separated from the metal being cast by a layer of graphite.

11. A mould according to claim 1 characterised in that the insert is of a material of the same composition as that of the film.

* * * * *